US008130179B2

(12) United States Patent
Uchino et al.

(10) Patent No.: US 8,130,179 B2
(45) Date of Patent: Mar. 6, 2012

(54) DISPLAY DEVICE AND DRIVING METHOD OF DISPLAY DEVICE

(75) Inventors: Katsuhide Uchino, Kanagawa (JP); Tetsuro Yamamoto, Kanagawa (JP); Naobumi Toyomura, Kanagawa (JP)

(73) Assignee: Sony Corporation, Tokyo (JP)

( * ) Notice: Subject to any disclaimer, the term of this patent is extended or adjusted under 35 U.S.C. 154(b) by 870 days.

(21) Appl. No.: 12/222,852

(22) Filed: Aug. 18, 2008

(65) Prior Publication Data

US 2009/0073095 A1 Mar. 19, 2009

(30) Foreign Application Priority Data

Sep. 14, 2007 (JP) ..... 2007-238699

(51) Int. Cl.
*G09G 3/30* (2006.01)

(52) U.S. Cl. ..... 345/77; 345/76; 345/89; 345/690; 315/169.3

(58) Field of Classification Search ..... 345/76–78, 345/82, 87–89, 690; 315/169.3
See application file for complete search history.

(56) References Cited

U.S. PATENT DOCUMENTS 5,684,365 A 11/1997 Tang et al.

FOREIGN PATENT DOCUMENTS

JP 08-234683 A 9/1996

*Primary Examiner* — Amare Mengistu
*Assistant Examiner* — Koosha Sharifi-Tafreshi
(74) *Attorney, Agent, or Firm* — Rader, Fishman & Grauer PLLC

(57) ABSTRACT

The present invention sets a display device for displaying a desired image on a display section, the display section being formed by arranging pixels in a form of a matrix, by outputting a driving signal for a signal line and a writing signal to the signal line and a scanning line of the display section by a horizontal driving circuit and a vertical driving circuit, wherein the pixel includes a light emitting element, a signal level storage capacitor, a transistor for writing.

4 Claims, 13 Drawing Sheets

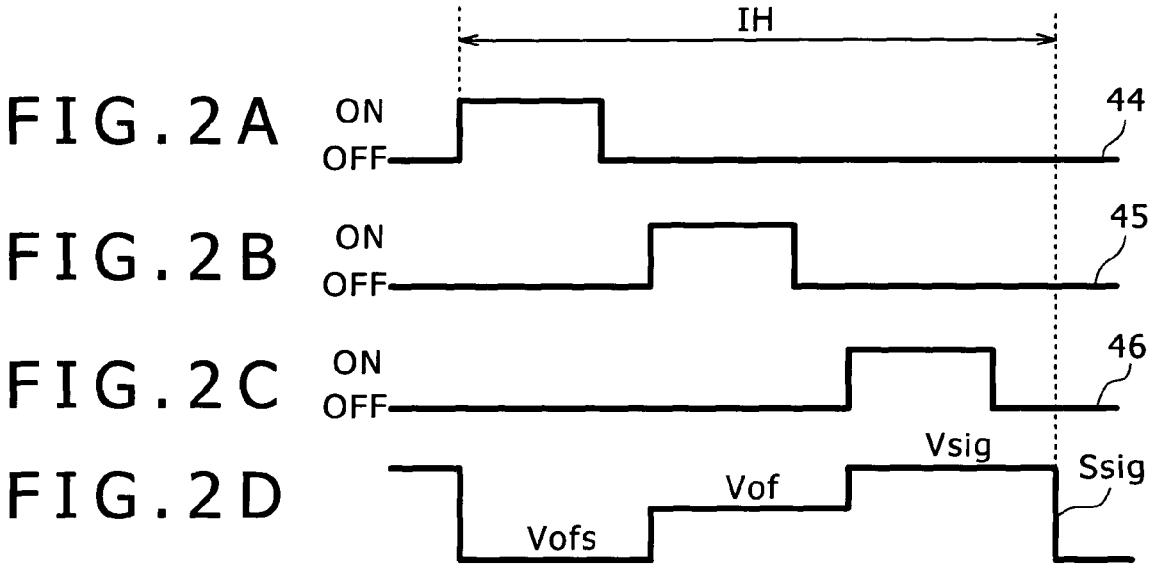
IH
FIG.2A
ON
OFF
44
FIG.2B
ON
OFF
45
FIG.2C
ON
OFF
46
FIG.2D
Vsig
Vof
Ssig
Vofs
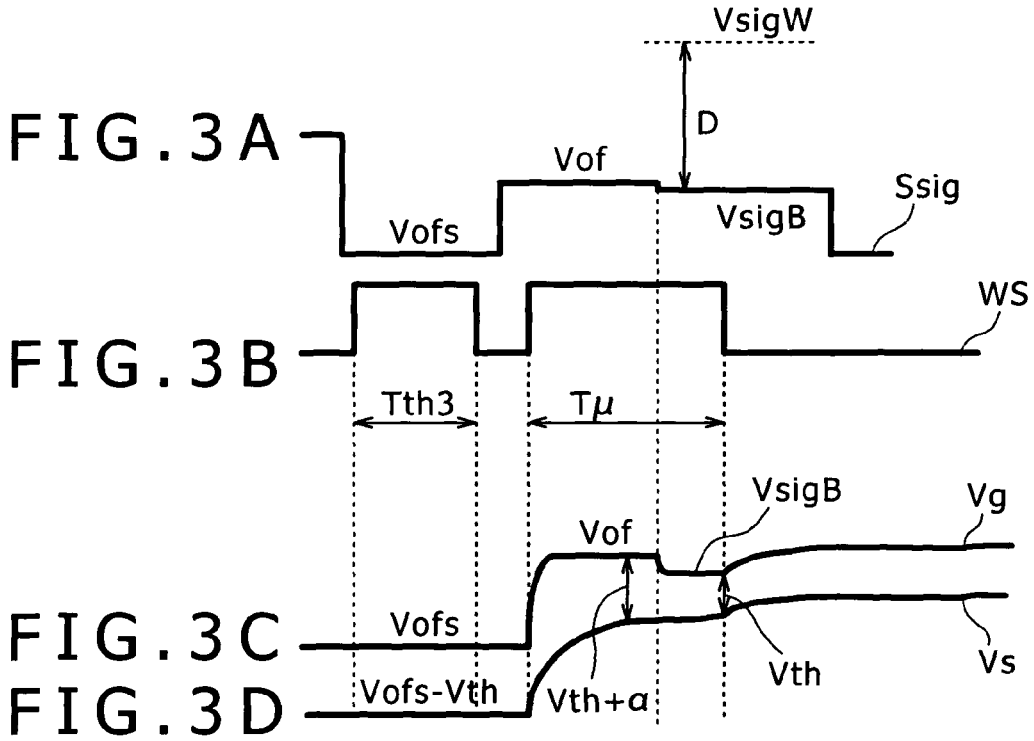
VsigW
D
FIG.3A
Vof
Ssig
Vofs
VsigB
WS
FIG.3B
Tth3
Tμ
VsigB
Vg
Vof
FIG.3C
Vofs
Vth
Vs
FIG.3D
Vofs-Vth
Vth+α

VsigW
D
VsigB
Ssig
Vofs
Vof
WS
Tth3
Tμ
Vg
VsigW
Vs
Vofs
Vof
Vth
Vofs-Vth

DISPLAY DEVICE AND DRIVING METHOD OF DISPLAY DEVICE

CROSS REFERENCES TO RELATED APPLICATIONS

The present invention contains subject matter related to Japanese Patent Application JP 2007-238699, filed in the Japan Patent Office on Sep. 14, 2007, the entire contents of which being incorporated herein by reference.

BACKGROUND OF THE INVENTION

1. Field of the Invention

The present invention relates to a display device and a driving method of a display device, and is applicable to an active matrix type display device based on an organic EL (Electro Luminescence) element, for example. The present invention sets, in advance, a voltage at another terminal of a signal level storage capacitor by a variable reference voltage that falls as a gradation used for display is raised, and thereafter sets a gradation voltage that corresponds to the gradation used for display and which increases as the gradation is raised at one terminal of the signal level storage capacitor, whereby a signal line is driven by a driving signal having a narrow dynamic range, and high luminance is secured.

2. Description of the Related Art

In related art, for a display device using an organic EL element, various devices have been proposed in U.S. Pat. No. 5,684,365, Japanese Patent Laid-Open No. Hei 8-234683, and the like.

FIG. 5 is a block diagram showing a conventional so-called active matrix type display device using an organic EL element. A display unit 2 in the display device 1 is formed by arranging pixels (PX) 3 in the form of a matrix. In addition, the display unit 2 has scanning lines SCN provided in line units in a horizontal direction for the pixels 3 arranged in the form of a matrix, and has signal lines SIG provided in each column so as to be orthogonal to the scanning lines SCN.

As shown in FIG. 6, each pixel 3 is formed by an organic EL element 8, which is a current-driven type self-luminous element, and a driving circuit (hereinafter referred to as a pixel circuit) of each pixel 3 which circuit drives the organic EL element 8.

In the pixel 3, one terminal of a signal level storage capacitor C1 is maintained at a fixed potential, and another terminal of the signal level storage capacitor C1 is connected to a signal line SIG via a transistor TR1 turned on and off by a writing signal WS. Thereby, in the pixel 3, the transistor TR1 is turned on by a rising edge of the writing signal WS, and a potential at the other terminal of the signal level storage capacitor C1 is set to a signal level of the signal line SIG. In timing in which the transistor TR1 is changed from an on state to an off state, the signal level of the signal line SIG is held by the other terminal of the signal level storage capacitor C1.

In the pixel 3, the other terminal of the signal level storage capacitor C1 is connected to the gate of a P-channel type transistor TR2, whose source is connected to a power supply Vcc, and the drain of the transistor TR2 is connected to the anode of the organic EL element 8. In this case, the pixel 3 is set such that the transistor TR2 operates in a saturation region at all times. As a result, the transistor TR2 forms a constant-current circuit supplying a drain-to-source current Ids expressed by the following equation, where Vgs is a gate-to-source voltage of the transistor TR2, μ is mobility, W is a channel width, L is a channel length, Cox is the capacitance of a gate insulating film per unit area, and Vth is a threshold voltage of the transistor TR2. Each pixel 3 thereby drives the organic EL element 8 by a driving current Ids corresponding to the signal level of the signal line SIG which signal level is held by the signal level storage capacitor C1.

$$I_{ds} = \frac{1}{2}\mu\frac{W}{L}C_{ox}(V_{gs} - V_{th})^2 \tag{1}$$

The display device 1 sequentially transfers a predetermined sampling pulse and generates the writing signal WS as a timing signal giving an instruction to write to each pixel 3 by a write scan circuit (WSCN) 4A of a vertical driving circuit 4. In addition, the display device 1 sequentially transfers a predetermined sampling pulse and generates a timing signal by a horizontal selector (HSEL) 5A of a horizontal driving circuit 5. The display device 1 sets each signal line SIG to the signal level of an input signal S1 with the timing signal as a reference. Thereby, on a dot-sequential basis or a line-sequential basis, the display device 1 sets the terminal voltage of the signal level storage capacitor C1 which capacitor is provided in the display unit 2 according to the input signal S1. The display device 1 thus displays an image based on the input signal S1.

As shown in FIG. 7, the organic EL element 8 makes a secular change in current-voltage characteristic in a direction in which a current flows through the organic EL element 8 less easily with use. Incidentally, in FIG. 7, reference L1 indicates an initial characteristic, and reference L2 indicates a characteristic resulting from the secular change. However, when the organic EL element 8 is driven by the P-channel type transistor TR2 in the circuit configuration shown in FIG. 6, the transistor TR2 drives the organic EL element 8 according to a gate-to-source voltage Vgs set according to the signal level of the signal line SIG, whereby change in luminance of each pixel due to the secular change in the current-voltage characteristic can be prevented.

When all transistors forming the pixel circuit, the horizontal driving circuit, and the vertical driving circuit are formed by an N-channel type transistor, these circuits can be produced on an insulating substrate such as a glass substrate or the like by an amorphous silicon process, and thus the display device can be produced easily.

However, as shown in FIG. 8 by contrast with FIG. 6, when each pixel 13 is formed with an N-channel type applied to a transistor TR2, and a display device 11 is formed by a display unit 12 using the pixels 13, the source of the transistor TR2 is connected to an organic EL element 8, and thereby the gate-to-source voltage Vgs of the transistor TR2 is changed due to the change in current-voltage characteristic as shown in FIG. 7. Thus, in this case, a current flowing through the organic EL element 8 gradually decreases with use, and the light emission luminance of the organic EL element 8 gradually decreases. In addition, with the configuration shown in FIG. 8, the light emission luminance varies in each pixel due to variations in characteristic of the transistor TR2. Incidentally, the variations in light emission luminance disturb uniformity on a display screen, and are perceived as nonuniformity or asperity on the display screen.

Thus, forming each pixel as shown in FIG. 9 is conceivable as a device for preventing the decrease in light emission luminance due to the secular change of such an organic EL element and the variations in light emission luminance due to the characteristic variations.

In this case, a display unit 22 in a display device 21 shown in FIG. 9 is formed by arranging pixels 23 in the form of a matrix. In a pixel 23, one terminal of a signal level storage capacitor C1 is connected to the anode of an organic EL element 8. Another terminal of the signal level storage capacitor C1 is connected to a signal line SIG via a transistor TR1 that is turned on and off according to a writing signal WS. Thus, in the pixel 23, voltage at the other terminal of the signal level storage capacitor C1 is set to the signal level of the signal line SIG according to the writing signal WS.

In the pixel 23, the two terminals of the signal level storage capacitor C1 are connected to the source and the gate of a transistor TR2. The drain of the transistor TR2 is connected to a scanning line SCN for power supply. The pixel 23 thereby drives the organic EL element 8 by a transistor TR2 of a source follower circuit configuration whose gate voltage is set to the signal level of the signal line SIG. Incidentally, Vcat in this case is the cathode potential of the organic EL element 8.

The display device 21 outputs the writing signal WS and a driving signal DS for power by a write scan circuit (WSCN) 24A and a drive scan circuit (DSCN) 24B of a vertical driving circuit 24. In addition, the display device 21 outputs a driving signal Ssig to the signal line SIG by a horizontal selector (HSEL) 25A of a horizontal driving circuit 25. The display device 21 thereby controls the operation of the pixel 23.

FIGS. 10A, 10B, 10C, 10D, and 10E are time charts showing the operation of the pixel 23. During an emission period during which the organic EL element 8 emits light, as shown in FIG. 11, the transistor TR1 is set in an off state by the writing signal WS, and the transistor TR2 is supplied with a power supply voltage Vcc by the driving signal DS (FIGS. 10A and 10B). Thereby, in the pixel 23, the gate voltage Vg and the source voltage Vs (FIGS. 10D and 10E) of the transistor TR2 are retained as voltages of the two terminals of the signal level storage capacitor C1. A driving current Ids based on the gate voltage Vg and the source voltage Vs drives the organic EL element 8. Incidentally, this driving current Ids is expressed by Equation (1).

In the pixel 23, when the emission period ends, as shown in FIG. 12, the drain voltage of the transistor TR2 is lowered to a predetermined voltage Vss by the driving signal DS. In this case, the voltage Vss is set to a voltage lower than a voltage obtained by adding the cathode voltage Vcath of the organic EL element 8 to the threshold voltage Vth of the organic EL element 8. Thereby, in the pixel 23, the driving signal DS side of the transistor TR2 for driving functions as a source, the anode voltage (voltage Vs in FIG. 10E) is lowered, and the organic EL element 8 stops emitting light.

At this time, in the pixel 23, as shown by an arrow in FIG. 12, an accumulated charge is discharged from the organic EL element 8 side of the signal level storage capacitor C1. Thereby, the anode voltage of the organic EL element 8 is lowered, and set to the voltage Vss.

Next, in the pixel 23, as shown in FIG. 13, the signal line SIG is lowered to a predetermined voltage Vofs by the driving signal Ssig, and the transistor TR1 is changed to an on state by the writing signal WS (FIGS. 10A and 10C). Thereby, in the pixel 23, the gate voltage Vg of the transistor TR2 is set to the voltage Vofs of the signal line SIG, and the gate-to-source voltage Vgs of the transistor TR2 is set to Vofs−Vss. In this case, letting Vth be the threshold voltage of the transistor TR2, the voltage Vofs is set such that the gate-to-source voltage Vgs (Vofs−Vss) of the transistor TR2 is higher than the threshold voltage Vth of the transistor TR2.

Next, in the pixel 23, for a period indicated by a reference Tth1 in FIGS. 10A to 10E, as shown in FIG. 14, the drain voltage of the transistor TR2 is raised to the power supply voltage Vcc by the driving signal DS with the transistor TR1 retained in an on state. Thereby, in the pixel 23, when a voltage between the terminals of the signal level storage capacitor C1 is higher than the threshold voltage of the transistor TR2, as shown by an arrow in FIG. 14, a charge current flows from the power supply Vcc to the terminal on the organic EL element 8 side of the signal level storage capacitor C1 via the transistor TR2, and the voltage Vs of the terminal on the organic EL element 8 side rises gradually. In this case, an equivalent circuit of the organic EL element 8 is expressed as a parallel circuit of a diode and a capacitance Cel. In this case, a current also flows from the power supply Vcc into the organic EL element 8 via the transistor TR2 in the state shown in FIG. 14. However, unless a voltage between the terminals of the organic EL element 8 exceeds the threshold voltage of the organic EL element 8 due to a rise in source voltage of the transistor TR2, because a leakage current of the organic EL element 8 is considerably smaller than the current of the transistor TR2, the current flowing into the organic EL element 8 is used to charge the signal level storage capacitor C1 and the capacitance Cel of the organic EL element 8. Hence, in the pixel 23, only the source voltage of the transistor TR2 simply rises without the organic EL element 8 emitting light.

In the pixel 23, the transistor TR1 is next changed to an off state by the writing signal WS, and the signal level of the signal line SIG is set to a signal level Vsig indicating the gradation of a corresponding pixel in a next line but one. Thereby, in the pixel 23, the charge current from the power supply Vcc via the transistor TR2 continues flowing to the terminal on the organic EL element 8 side of the signal level storage capacitor C1, and the source voltage Vs of the transistor TR2 continues rising. Also, in this case, the gate voltage Vg of the transistor TR2 rises in such a manner as to follow the voltage rise in the source voltage Vs. Incidentally, the signal level Vsig of the signal line SIG during this period is used to set the gradation of the corresponding pixel in the next line but one.

In the pixel 23, after the passage of a certain time, the signal level of the signal line SIG is changed to the voltage Vofs again. Thus, for a period indicated by a reference Tth2 in FIGS. 10A to 10E, with the potential on the signal line SIG side of the signal level storage capacitor C1 maintained at the voltage Vofs, when the voltage between the terminals of the signal level storage capacitor C1 is higher than the threshold voltage of the transistor TR2, a charge current flows from the power supply Vcc to the terminal on the organic EL element 8 side of the signal level storage capacitor C1 via the transistor TR2, and the source voltage Vs of the transistor TR2 rises gradually. Thereby, as shown in FIG. 15, the source voltage Vs of the transistor TR2 rises gradually such that the gate-to-source voltage Vgs of the transistor TR2 approaches the threshold voltage Vth of the transistor TR2. When the gate-to-source voltage Vgs of the transistor TR2 becomes the threshold voltage Vth of the transistor TR2, the inflow of the charge current via the transistor TR2 stops.

The pixel 23 repeats the process of the inflow of the charge current to the terminal on the organic EL element 8 side of the signal level storage capacitor C1 via the transistor TR2 a sufficient number of times for the gate-to-source voltage Vgs of the transistor TR2 to become the threshold voltage Vth of the transistor TR2 (three times indicated by references Tth1, Tth2, and Tth3 in the example of FIGS. 10A to 10E). Thereby, as shown in FIG. 16, the threshold voltage Vth of the transistor TR2 is set in the signal level storage capacitor C1. Incidentally, the voltages Vofs and Vcat are set such that Vel=Vofs−Vth≦Vcat+Vthel in a state in which the threshold voltage Vth of the transistor TR2 is set in the signal level storage capacitor C1. Thus, the setting is made such that the organic EL element 8 does not emit light. In this case, Vthel is the threshold voltage of the organic EL element 8, and Vel is the voltage of the terminal on the transistor TR2 side of the organic EL element 8.

In the pixel 23, the potential on the signal line SIG side of the signal level storage capacitor C1 is thereafter set to a voltage Vsig indicating the light emission luminance of the organic EL element 8. The voltage indicating the gradation is thus set in the signal level storage capacitor C1 in such a manner as to cancel the threshold voltage Vth of the transistor TR2. Thereby variation in light emission luminance due to variation in threshold voltage Vth of the transistor TR2 is prevented.

Specifically, as shown in FIG. 17, in the pixel 23, after the passage of the period Tth3, the signal level of the signal line SIG is set to a signal level Vsig indicating the light emission luminance of the pixel 23. Next, as shown in a period Tμ, the transistor TR1 is set in an on state by the writing signal WS. Thereby, in the pixel 23, the terminal on the signal line SIG side of the signal level storage capacitor C1 is set to the signal level Vsig of the signal line SIG, a current corresponding to the gate-to-source voltage Vgs as the voltage between the terminals of the signal level storage capacitor C1 flows from the power supply Vcc into the terminal of the organic EL element 8 on the side of the signal level storage capacitor C1 via the transistor TR2, and the source voltage Vs of the transistor TR2 rises gradually.

The current flowing in via the transistor TR2 in this case changes according to the mobility of the transistor TR2. Thereby, as shown in FIG. 18, the source voltage Vs of the transistor TR2 increases rising speed thereof as the mobility of the transistor TR2 is increased. In addition, the current of the transistor TR2 driving the organic EL element 8 increases according to the mobility. In this case, the transistor TR2 of this kind is a polysilicon TFT or the like, and has disadvantages of large variations in threshold voltage Vth and mobility μ.

Thereby, in the pixel 23, for a certain period indicated by the reference Tμ, the transistor TR2 is made to perform an on operation to pass a charge current into the terminal on the organic EL element 8 side of the signal level storage capacitor C1 in a state in which the voltage on the signal line SIG side of the signal level storage capacitor C1 is maintained at the signal level Vsig. The voltage between the terminals of the signal level storage capacitor C1 is thereby lowered by an amount corresponding to the mobility of the transistor TR2. Variation in light emission luminance due to variation in mobility of the transistor TR2 is thus prevented.

In the pixel 23, when the certain period Tμ has passed, the transistor TR1 is turned off by the writing signal WS, so that the signal level Vsig of the signal line SIG is held by the signal level storage capacitor C1, and an emission period begins. Incidentally, it is understood from the above description that the driving signal Ssig of the signal line SIG repeats the signal level Vsig sequentially indicating the gradation of each pixel 23 connected to one signal line with the fixed voltage Vofs inserted between the signal levels Vsig.

The display device of this kind is desired to provide a high yield and high luminance. The yield can be improved by widening a space between pieces of wiring and reducing an area used for a TFT. When this method is used, however, the transistor TR2 driving the organic EL element 8 needs to be miniaturized. As a result, a change in drain current with respect to a change in gate voltage becomes small. It is thus difficult to ensure high luminance.

A conceivable method for solving this problem is to widen the dynamic range of the signal level Vsig indicating the gradation of each pixel and drive the signal line by the driving signal having the wide dynamic range. In this case, however, power consumption increases, and the configuration of the horizontal driving circuit becomes complex.

It is also conceivable that light emission luminance may be heightened by simply lowering the fixed voltage Vofs for threshold voltage correction and thus apparently widening the dynamic range of the gate voltage of the transistor TR2. In this case, however, it is difficult to sink black sufficiently, and contrast is degraded.

SUMMARY OF THE INVENTION

The present invention has been made in view of the above. It is desirable to propose a display device and a driving method of the display device that can drive a signal line by a driving signal having a narrow dynamic range and ensure high luminance.

According to an embodiment of the present invention, there is provided a display device for displaying a desired image on a display section, the display section being formed by arranging pixels in a form of a matrix, by outputting a driving signal for a signal line and a writing signal to the signal line and a scanning line of the display section by a horizontal driving circuit and a vertical driving circuit, wherein the pixel includes a light emitting element, a signal level storage capacitor, a transistor for writing, the transistor for writing being turned on by the writing signal to set a voltage of one terminal of the signal level storage capacitor to a signal level of the signal line, and a transistor for driving, the transistor for driving having a gate and a source connected to two terminals of the signal level storage capacitor, and driving the light emitting element and making the light emitting element emit light according to a voltage between the terminals of the signal level storage capacitor, and the horizontal driving circuit and the vertical driving circuit in a non-emission period in which light emission of the light emitting element is stopped sequentially set a signal level of the driving signal for the signal line to a fixed voltage lower than a voltage corresponding to a black gradation of the light emitting element, a variable reference voltage that falls as a gradation of the light emitting element is increased, and a gradation voltage that corresponds to the gradation at which to make the light emitting element emit light and which increases as the gradation at which to make the light emitting element emit light is increased, during a period during which the signal level of the driving signal for the signal line is set at the fixed voltage, make the transistor for writing perform an on operation by the writing signal to set the voltage of one terminal of the signal level storage capacitor to the fixed voltage, and charge another terminal of the signal level storage capacitor by the transistor for driving to set the voltage between the terminals of the signal level storage capacitor to a threshold voltage of the transistor for driving, during a period during which the signal level of the driving signal for the signal line is set at the variable reference voltage and the gradation voltage, make the transistor for writing perform an on operation by the writing signal to set the voltage of one terminal of the signal level storage capacitor to the variable reference voltage, and set a voltage of the other terminal of the signal level storage capacitor to a voltage corresponding to the variable reference voltage, and then set the voltage of one terminal of the signal level storage capacitor to the gradation voltage, charge the other terminal of the signal level storage capacitor by the transistor for driving, and make the transistor for writing perform an off operation, whereby variation in mobility of the transistor for driving is corrected, and the gradation voltage is held by the signal level storage capacitor, and when the light emitting element displays a black gradation, generate the variable reference voltage that is a high voltage higher than the gradation voltage and which falls from the high voltage as the gradation of the light emitting element is increased.

In addition, according to an embodiment of the present invention, there is provided a driving method of a display device for displaying a desired image on a display section, the display section being formed by arranging pixels in a form of a matrix, by outputting a driving signal for a signal line and a writing signal to the signal line and a scanning line of the display section, wherein the pixel includes a light emitting element, a signal level storage capacitor, a transistor for writing, the transistor for writing being turned on by the writing signal to set a voltage of one terminal of the signal level storage capacitor to a signal level of the signal line, and a transistor for driving, the transistor for driving having a gate and a source connected to two terminals of the signal level storage capacitor, and driving the light emitting element and making the light emitting element emit light according to a voltage between the terminals of the signal level storage capacitor, the driving method including the steps of: in a non-emission period in which light emission of the light emitting element is stopped, sequentially setting a signal level of the driving signal for the signal line to a fixed voltage lower than a voltage corresponding to a black gradation of the light emitting element, a variable reference voltage that falls as a gradation of the light emitting element is increased, and a gradation voltage that corresponds to the gradation at which to make the light emitting element emit light and which increases as the gradation at which to make the light emitting element emit light is increased; during a period during which the signal level of the driving signal for the signal line is set at the fixed voltage, making the transistor for writing perform an on operation by the writing signal to set the voltage of one terminal of the signal level storage capacitor to the fixed voltage, and charging another terminal of the signal level storage capacitor by the transistor for driving to set the voltage between the terminals of the signal level storage capacitor to a threshold voltage of the transistor for driving; during a period during which the signal level of the driving signal for the signal line is set at the variable reference voltage and the gradation voltage, making the transistor for writing perform an on operation by the writing signal to set the voltage of one terminal of the signal level storage capacitor to the variable reference voltage, and setting a voltage of the other terminal of the signal level storage capacitor to a voltage corresponding to the variable reference voltage, and then setting the voltage of one terminal of the signal level storage capacitor to the gradation voltage, charging the other terminal of the signal level storage capacitor by the transistor for driving, and making the transistor for writing perform an off operation, whereby variation in mobility of the transistor for driving is corrected, and the gradation voltage is held by the signal level storage capacitor; and when the light emitting element displays a black gradation, generating the variable reference voltage that is a high voltage higher than the gradation voltage and which falls from the high voltage as the gradation of the light emitting element is increased.

With the configuration of the foregoing embodiments, when the threshold voltage of the transistor for driving is set in the signal level storage capacitor using the fixed voltage lower than the voltage corresponding to the black gradation, and thereafter the variable reference voltage that falls as the gradation of the light emitting element is increased and the gradation voltage that corresponds to the gradation at which to make the light emitting element emit light and which increases as the gradation is increased are sequentially set, a potential difference between the variable reference voltage and the gradation voltage can be set in the signal level storage capacitor, and thus the voltage between the terminals of the signal level storage capacitor can be set in a wide dynamic range as compared with the variable reference voltage and the gradation voltage. As a result, high contrast can be ensured by the voltage between the terminals which voltage has the wide dynamic range. Thus, high contrast can be ensured by driving using a driving signal having a narrow dynamic range for the variable reference voltage and a driving signal having a narrow dynamic range for the gradation voltage.

According to the present invention, it is possible to drive a signal line by a driving signal having a narrow dynamic range and ensure high contrast.

BRIEF DESCRIPTION OF THE DRAWINGS

FIGS. 2A, 2B, 2C, and 2D are time charts of assistance in explaining generation of a driving signal in the display device of FIG. 1;

FIGS. 3A, 3B, 3C, and 3D are time charts of assistance in explaining black display in the display device of FIG. 1;

DETAILED DESCRIPTION OF THE PREFERRED EMBODIMENTS

Figure 1:
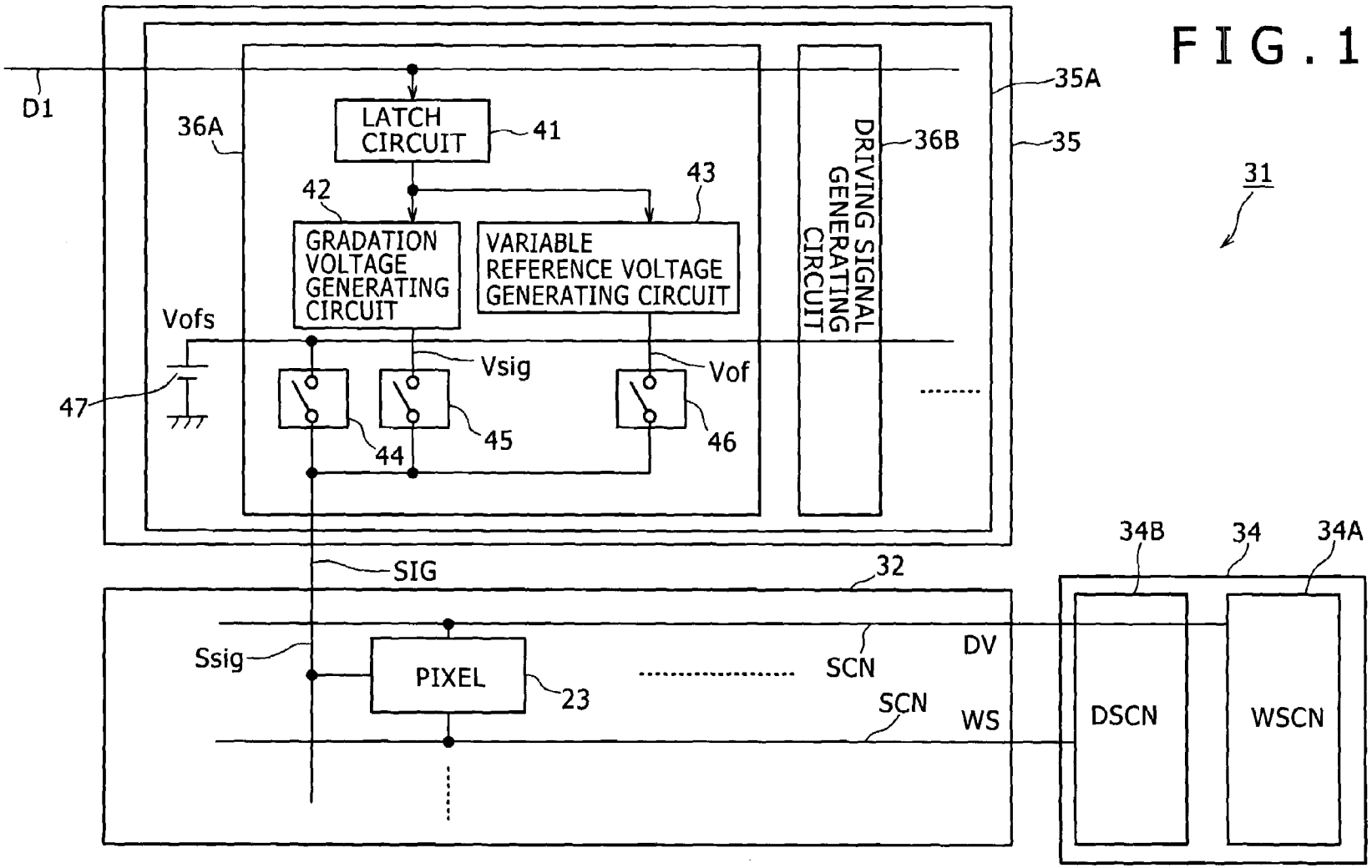
FIG. 1 is a block diagram showing a configuration of a display device according to a first embodiment of the present invention.
Figures 4A, 4B, 4C, 4D:
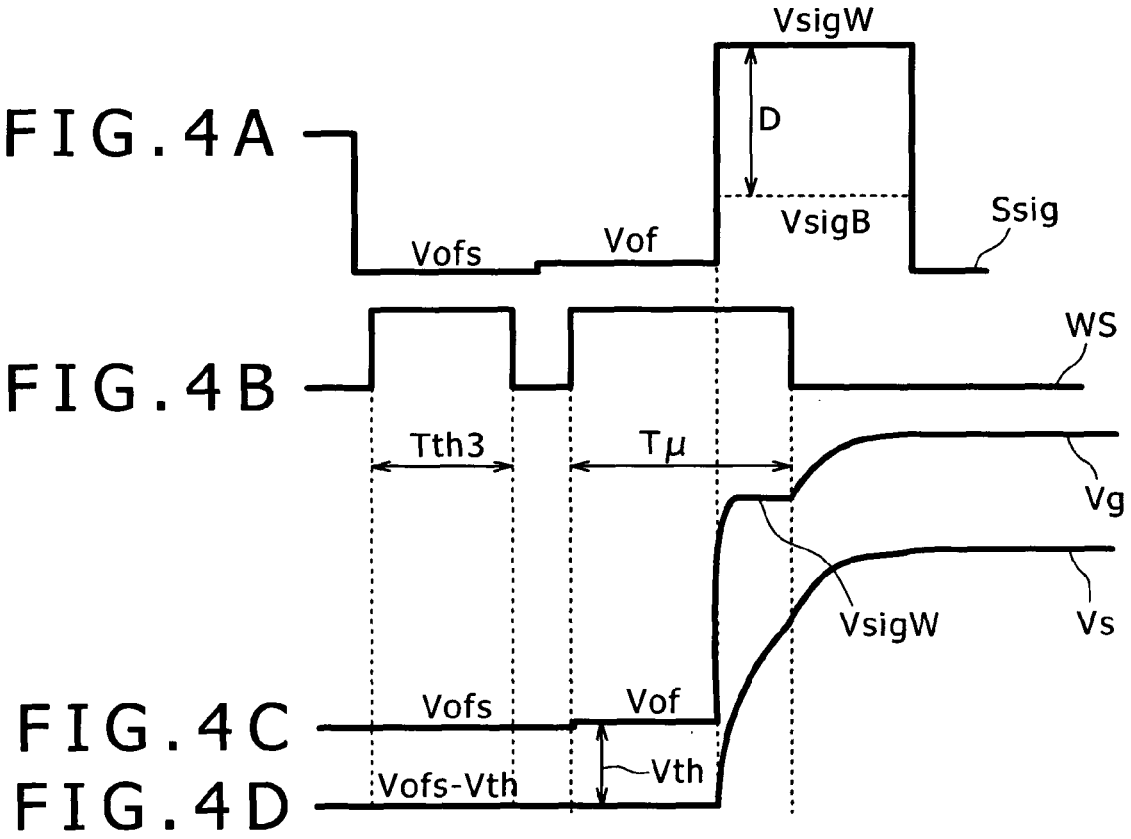
FIGS. 4A, 4B, 4C, and 4D are time charts of assistance in explaining white display in the display device of FIG. 1.
Figure 5:
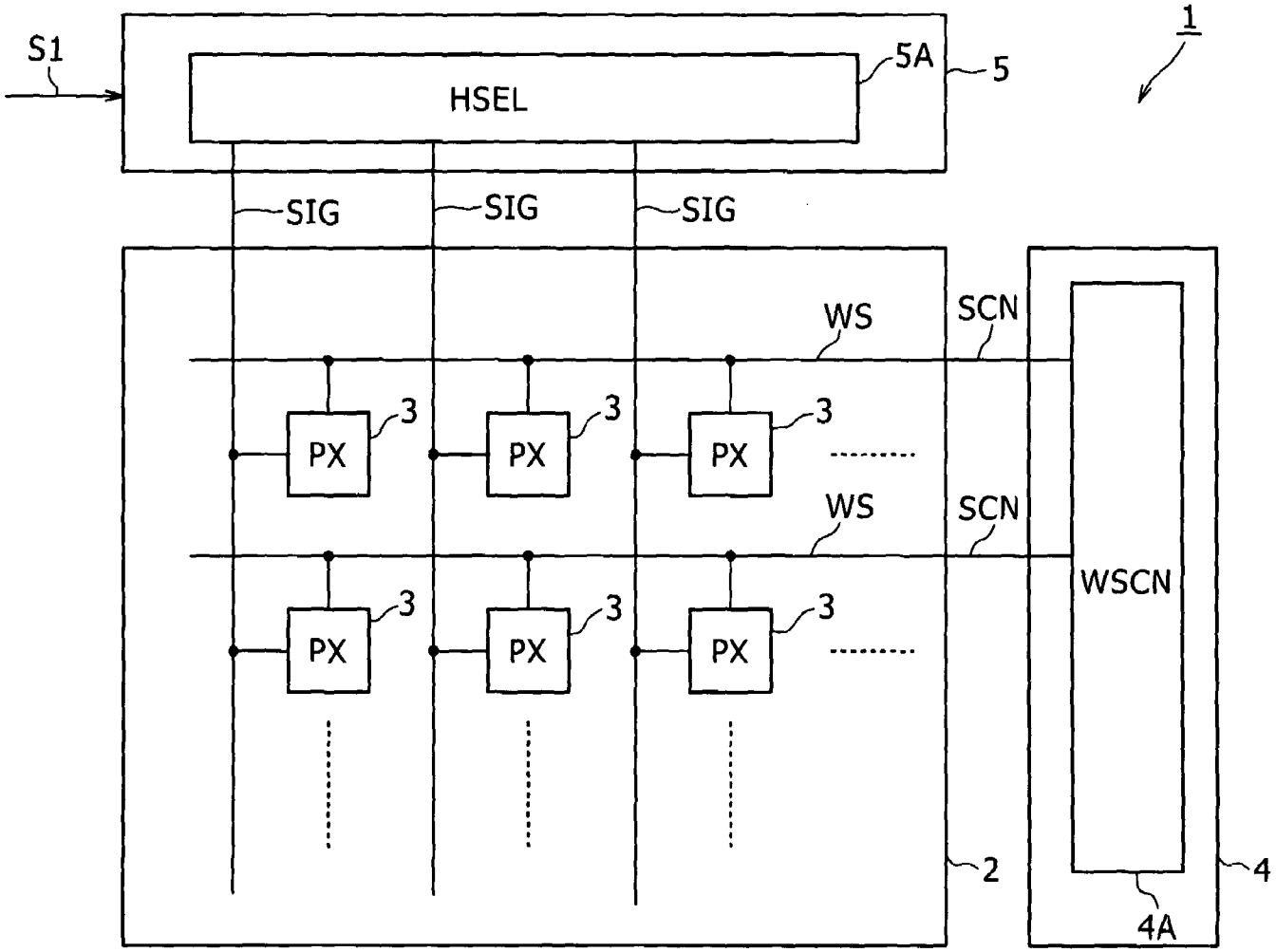
FIG. 5 is a diagram showing a conventional display device.
Figure 6:
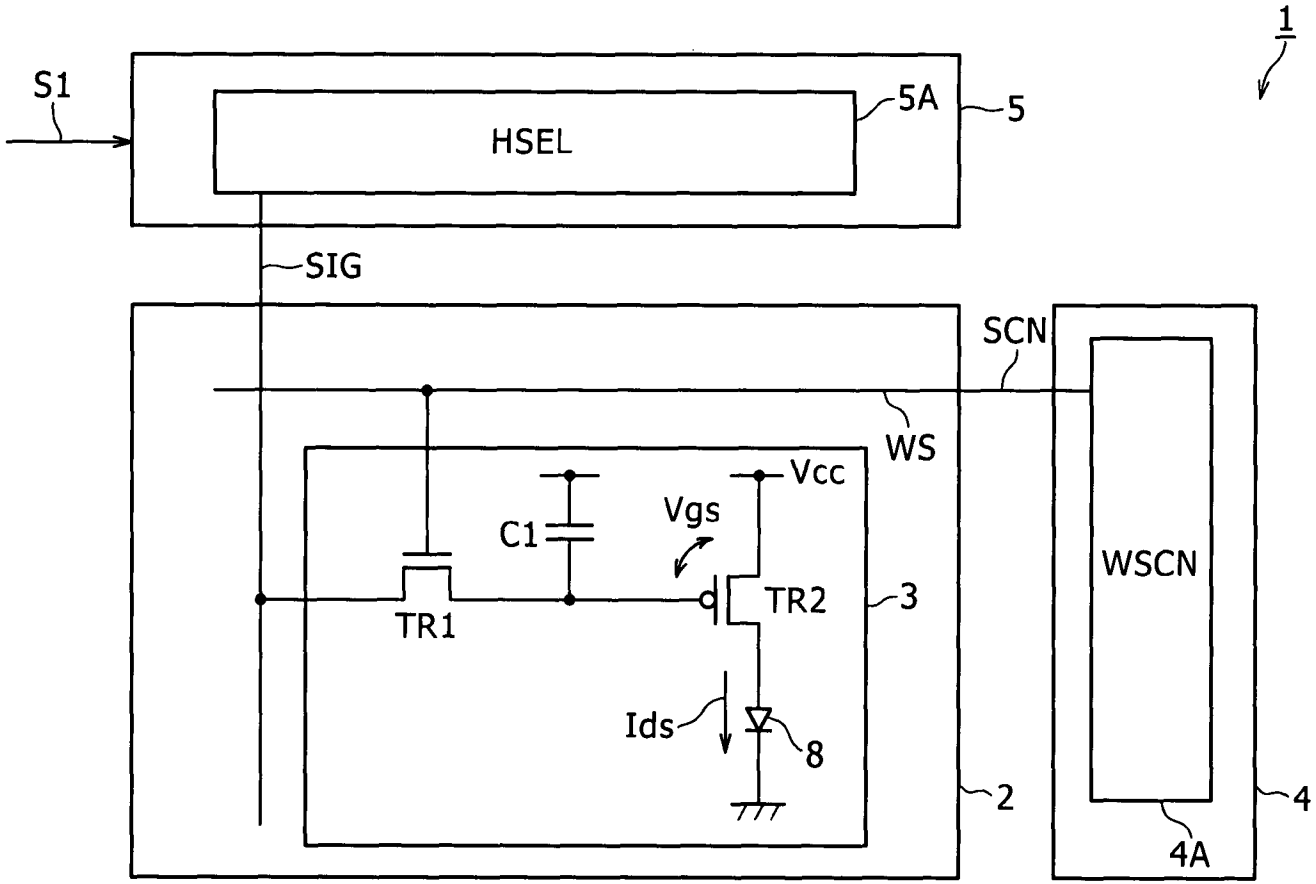
FIG. 6 is a block diagram showing the display device of FIG. 5 in detail.
Figure 7:
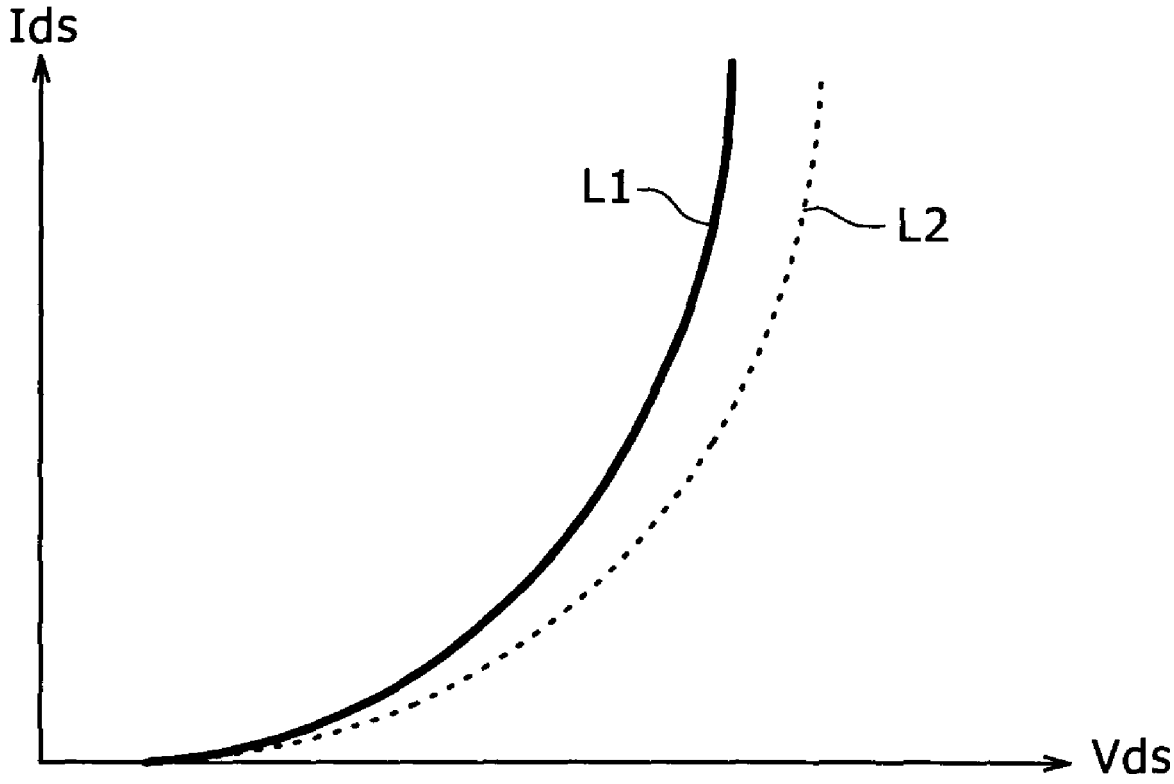
FIG. 7 is a characteristic curve diagram showing secular change of an organic EL element.
Figure 8:
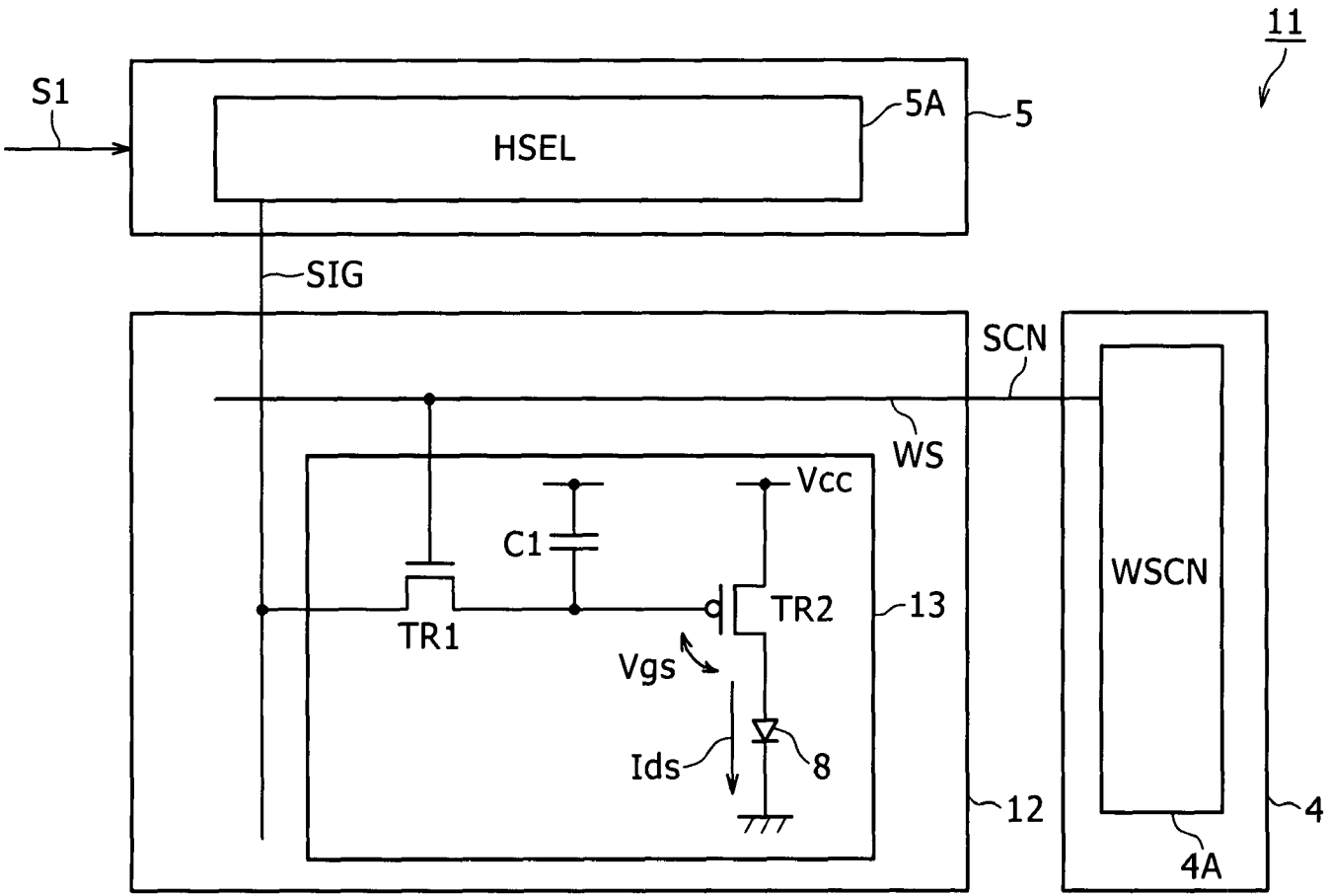
FIG. 8 is a block diagram showing a case where an N-channel type transistor is used in the configuration of FIG. 5.

Hereinafter preferred embodiments of the present invention will be described in detail referring to the drawings.

First Embodiment (1) Configuration of Embodiment

Figure 9:
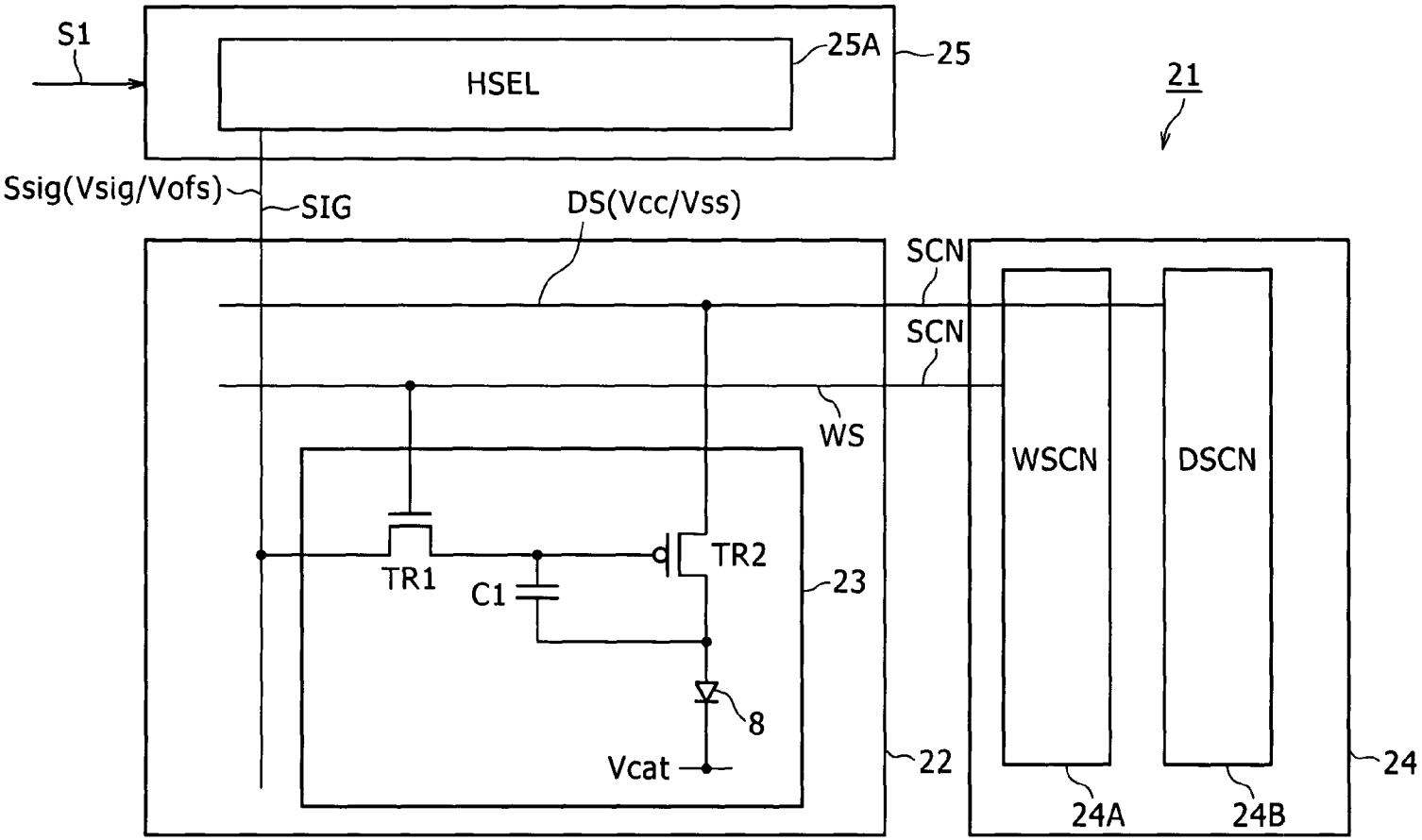
FIG. 9 is a block diagram showing a conceivable display device using an N-channel type transistor.
Figures 10A, 10B, 10C, 10D, 10E:
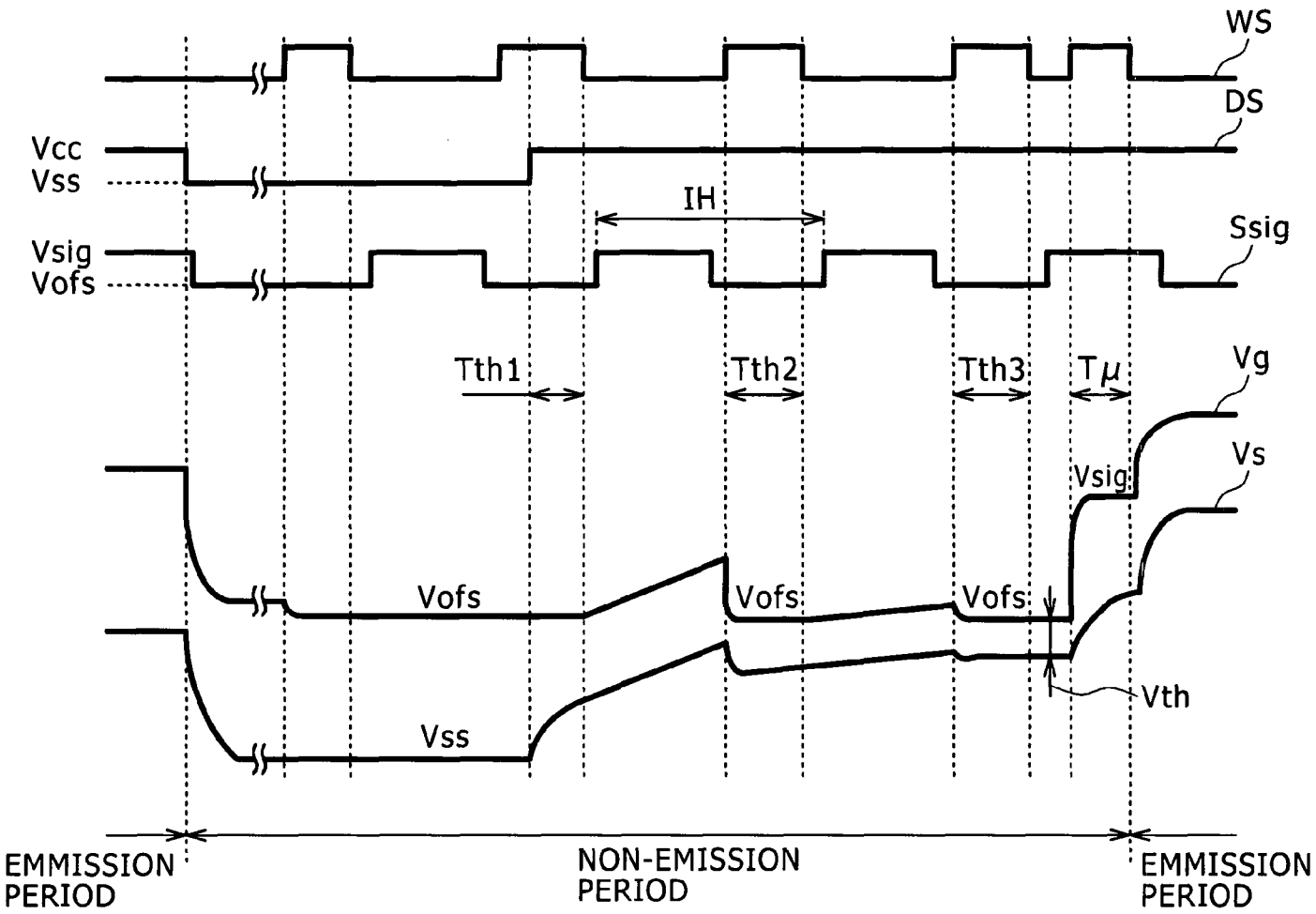
FIGS. 10A, 10B, 10C, 10D, and 10E are time charts of the display device of FIG. 9.
Figure 11:
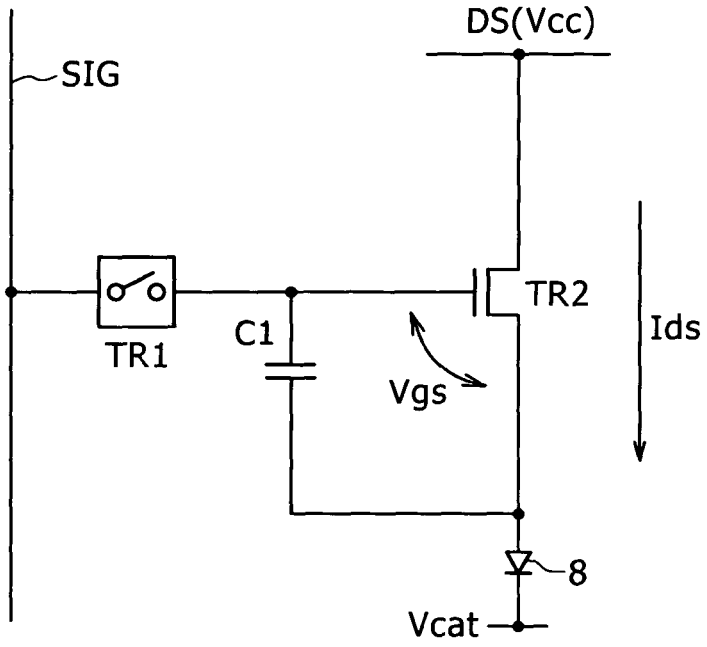
FIG. 11 is a connection diagram showing a setting of a pixel in an emission period in FIGS. 10A to 10E.
Figure 12:
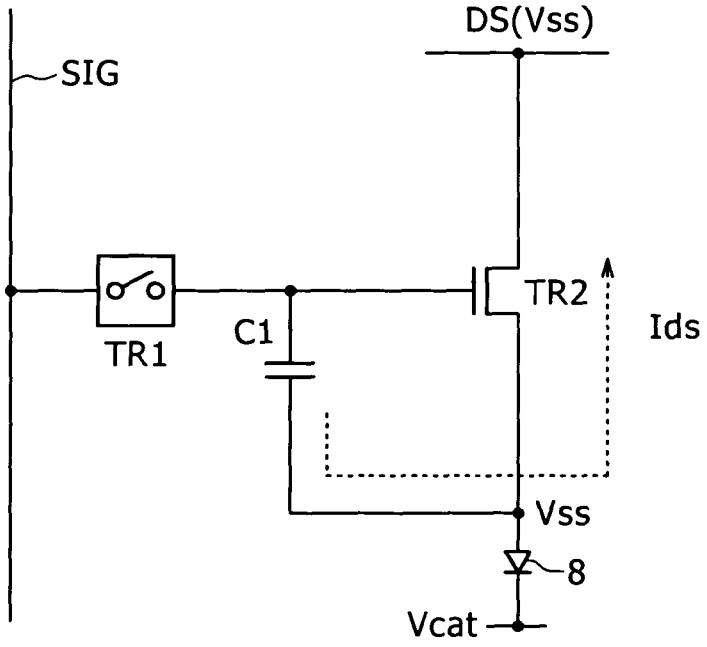
FIG. 12 is a connection diagram showing a continuation of FIG. 11.
Figure 13:
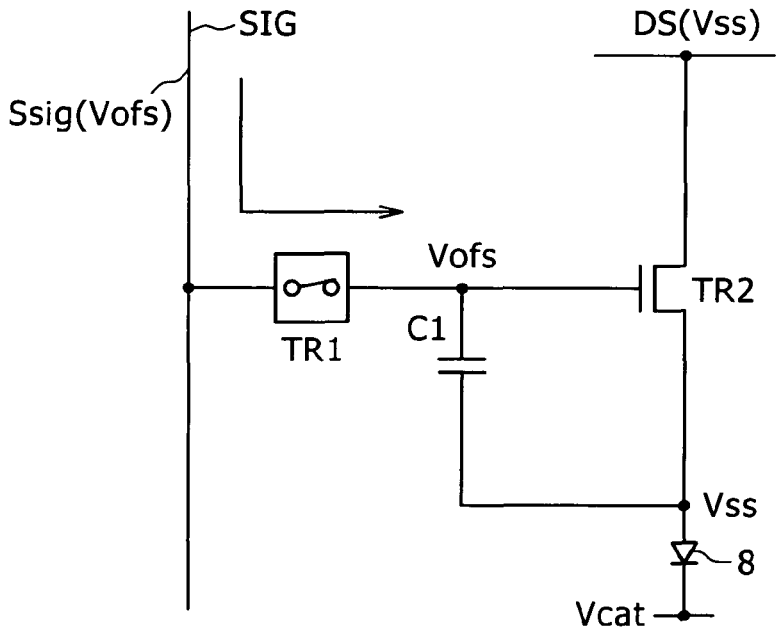
FIG. 13 is a connection diagram showing a continuation of FIG. 12.
Figure 14:
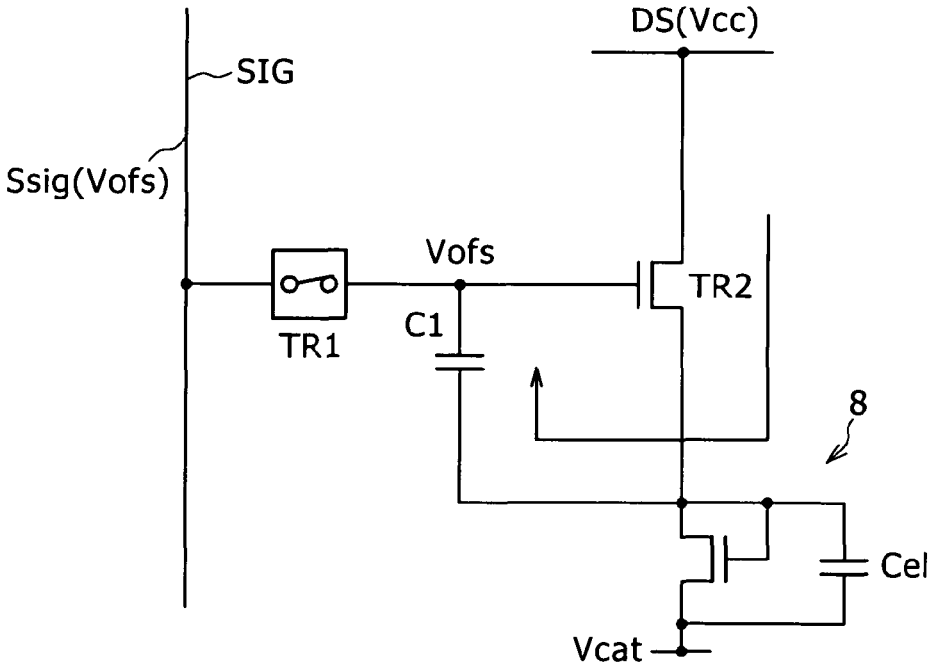
FIG. 14 is a connection diagram showing a continuation of FIG. 13.
Figure 15:
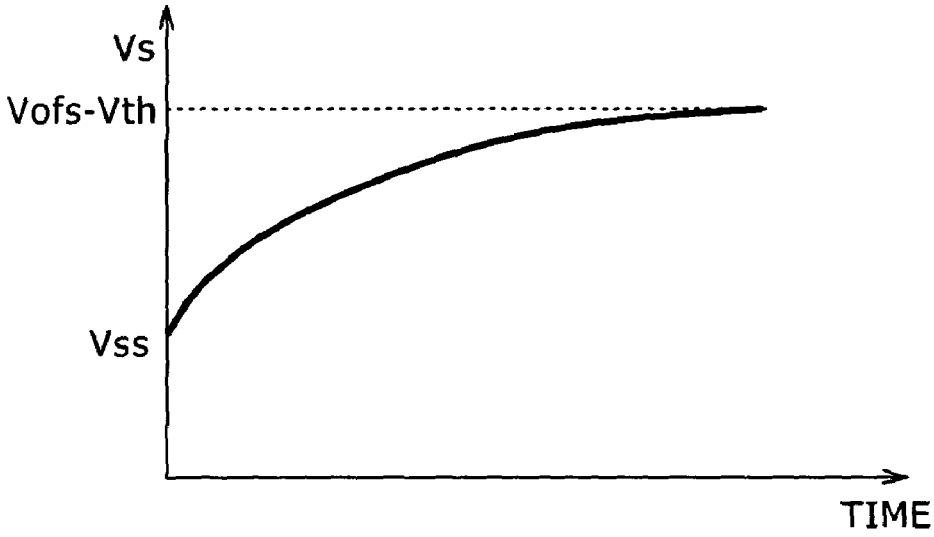
FIG. 15 is a characteristic curve diagram of assistance in explaining correction for a threshold voltage.
Figure 16:
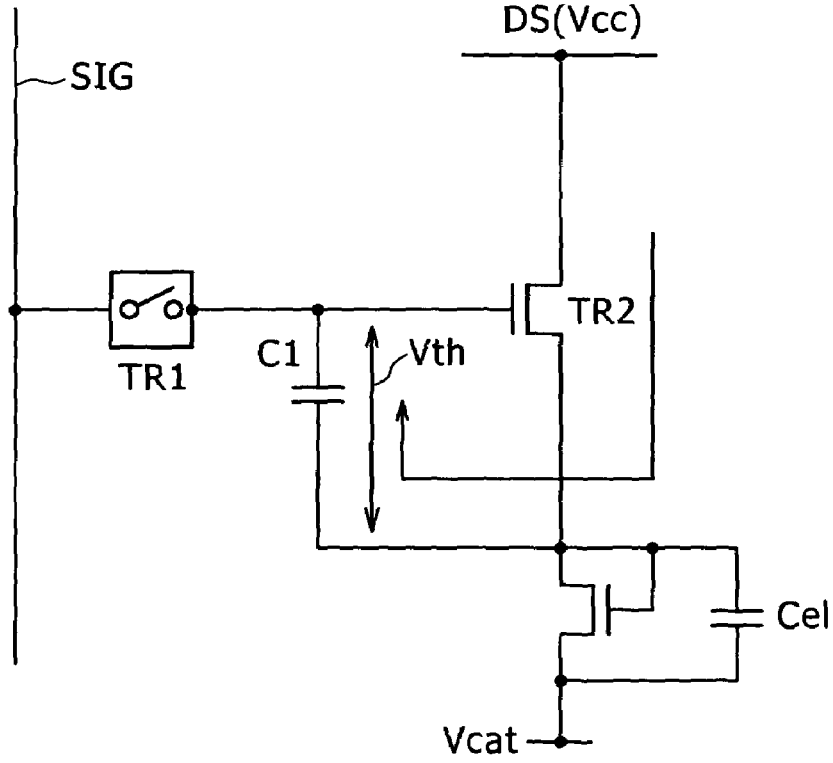
FIG. 16 is a connection diagram showing a continuation of FIG. 14.
Figure 17:
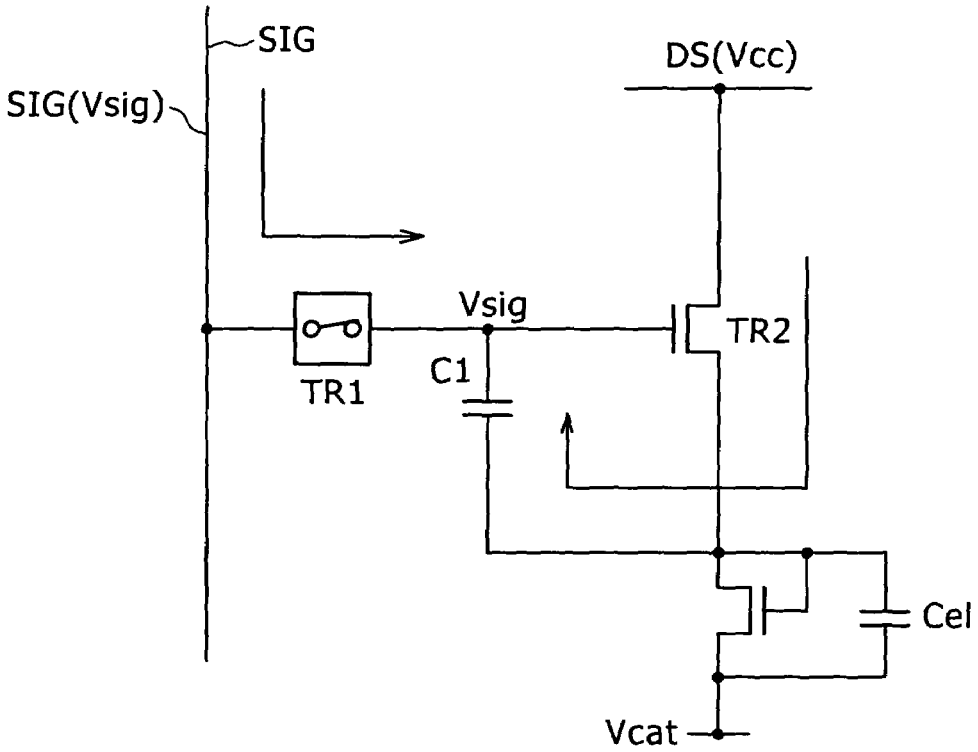
FIG. 17 is a connection diagram showing a continuation of FIG. 16.
Figure 18:
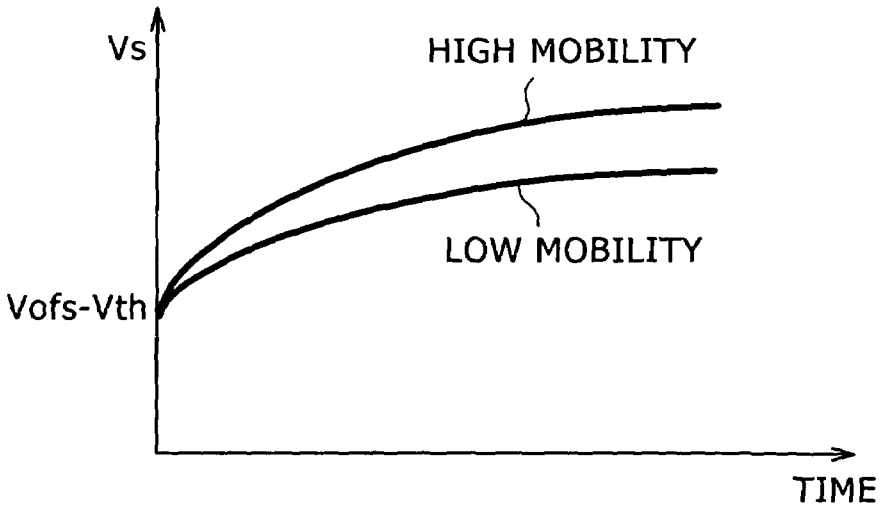
FIG. 18 is a characteristic curve diagram of assistance in explaining correction for mobility.

FIG. 1 is a block diagram showing a display device according to a first embodiment of the present invention by contrast with FIG. 9. In this display device 31, the same constituent elements as in the above-described display devices 1, 11, and 21 are identified by the same reference numerals, and repeated description thereof will be omitted.

In the display device 31, a display unit 32 is formed by arranging pixels 23 in the form of a matrix. Scanning lines SCN are provided in a line unit in a horizontal direction. A signal line SIG is provided in each column so as to be orthogonal to the scanning lines SCN. The display device 31 inputs a writing signal WS and a driving signal DS from a write scan circuit (WSCN) 34A and a drive scan circuit (DSCN) 34B disposed in a vertical driving circuit 34 to the scanning lines SCN. The display device 31 also inputs a driving signal Ssig from a horizontal selector (HSEL) 35A of a horizontal driving circuit 35 to the signal line SIG.

The horizontal selector 35A has driving signal generating circuits 36A, 36B, . . . for each signal line SIG of the display unit 32. The driving signal generating circuits 36A, 36B, . . . generate driving signals Ssig for the corresponding signal lines SIG.

Specifically, the horizontal selector 35A sequentially transfers a predetermined latch pulse by the driving signal generating circuits 36A, 36B, . . . . Each driving signal generating circuit 36 latches image data D1 by a latch circuit 41 according to the latch pulse. The horizontal selector 35A thereby allocates the image data D1 input in order of raster scanning, for example, to the corresponding signal lines SIG. A gradation voltage generating circuit 42 selects a reference voltage corresponding to the image data D1 latched by the latch circuit 41 from a plurality of reference voltages output from a reference voltage generating circuit provided in the horizontal selector 35A. The gradation voltage generating circuit 42 then outputs the reference voltage. The gradation voltage generating circuit 42 thereby subjects the image data D1 latched by the latch circuit 41 to analog-to-digital conversion processing, and generates a gradation voltage Vsig that corresponds to a gradation at which to make an organic EL element 8 emit light and which increases as the gradation is raised. The gradation voltage generating circuit 42 outputs the gradation voltage Vsig via a buffer circuit not shown in the figure.

As with the gradation voltage generating circuit 42, a variable reference voltage generating circuit 43 subjects the image data D1 latched by the latch circuit 41 to analog-to-digital conversion processing. The variable reference voltage generating circuit 43 thereby generates a variable reference voltage Vof. The variable reference voltage Vof in this case is a reference voltage that falls as the gradation of the organic EL element 8 is raised. When the organic EL element 8 displays a black gradation, the variable reference voltage Vof is higher than a gradation voltage VsigB (see FIGS. 3A to 3D) when the black gradation is displayed. When the organic EL element 8 displays a white gradation, the variable reference voltage Vof is equal to a fixed voltage Vofs. The variable reference voltage generating circuit 43 outputs the variable reference voltage Vof via a buffer circuit not shown in the figure.

A power supply circuit 47 outputs the fixed potential Vofs, which is a voltage lower than the gradation voltage VsigB corresponding to the black gradation. Switch circuits 44, 45, and 46 select and output the fixed potential Vofs, the gradation voltage Vsig, and the variable reference voltage Vof to the corresponding signal line SIG.

FIGS. 2A, 2B, 2C, and 2D are time charts of assistance in explaining the operation of the switch circuits 44, 45, and 46.

The display device 31 sets one horizontal scanning period as a repetition cycle, and turns on the switch circuits 44, 45, and 46 sequentially and selectively (FIGS. 2A to 2C). Thereby a driving signal Ssig for each signal line SIG is generated by being sequentially set at the fixed voltage Vofs, the gradation voltage Vsig, and the variable reference voltage Vof (FIG. 2D). Incidentally, thereby, the fixed voltage Vofs, the variable reference voltage Vof, and the gradation voltage Vsig are sequentially and cyclically repeated as the driving signal Ssig.

The display device 31 sequentially changes a line as an object for correction which line is corrected for variations in mobility in each horizontal scanning period. The display device 31 corrects the threshold voltage Vth of a transistor TR2 as in FIG. 9 described above in the horizontal scanning periods of two cycles immediately preceding a horizontal scanning period for mobility correction. Specifically, after the display device 31 lowers the driving signal DS to a predetermined voltage Vss, when a sufficient time for a terminal on the organic EL element 8 side of a signal level storage capacitor C1 to fall to the predetermined voltage Vss has passed, the display device 31 raises the driving signal DS to a power supply voltage Vcc. In addition, during periods during which the driving signal Ssig is set at the fixed voltage Vofs with the driving signal DS raised to the power supply voltage Vcc after being once lowered to the predetermined voltage VSS, the display device 31 selectively raises the writing signal WS to set a transistor TR1 in an on state. Thereby the display device 31 sets the threshold voltage Vth of the transistor TR2 in the signal level storage capacitor C1 in the horizontal scanning periods of the two cycles.

On the other hand, during the next period for mobility correction, as shown in FIGS. 3A to 3D and FIGS. 4A to 4D, in a period in which the driving signal Ssig is set at the fixed voltage Vofs with the driving signal DS raised to the power supply voltage Vcc, the writing signal WS is raised to set the transistor TR1 in the on state. Thereby, the threshold voltage Vth of the transistor TR2 is further corrected during a period Tth3 during which the writing signal WS is raised, and a potential across the signal level storage capacitor C1 is set to a voltage lower than the gradation voltage VsigB corresponding to the black gradation (FIGS. 3A to 3D and FIGS. 4A to 4D). Incidentally, the gate voltage Vg and the source voltage Vs of the transistor TR2 are thereby set at the voltage Vofs and a voltage Vofs−Vth, respectively. Incidentally, FIGS. 3A to 3D and FIGS. 4A to 4D are signal waveform charts in the cases of the organic EL element 8 making display at the black gradation and at the white gradation, respectively.

When a certain time has passed after the signal level of the driving signal Ssig is next changed to the variable reference voltage Vof, the display device 31 raises the writing signal WS. When a certain time has passed after the signal level of the driving signal Ssig is changed to the gradation voltage Vsig, the display device 31 lowers the writing signal WS. The display device 31 assigns a period Tμ during which the writing signal WS is raised as the period for mobility correction.

(2) Operation of Embodiment

In the display device 31 (FIG. 1) according to the present embodiment having the above-described constitution, the signal level Vsig of the signal line SIG is sequentially set in pixels 23 of the display unit 32 in line units by the driving of the signal line SIG and the scanning lines SCN by the horizontal driving circuit 35 and the vertical driving circuit 34, and the organic EL element 8 of each pixel 33 emits light at the set signal level Vsig (see FIG. 9), whereby a desired image is displayed on the display unit 32.

Specifically, in the display device 31, in a non-emission period, one terminal of the signal level storage capacitor C1 is set at the signal level Vsig of the signal line SIG. In an emission period, the transistor TR2 drives the organic EL element 8 according to a gate-to-source voltage Vgs as a voltage between the terminals of the signal level storage capacitor C1. Thereby, in the display device 31, the organic EL element 8 of each pixel 23 emits light at a light emission luminance corresponding to the signal level Vsig of the signal line SIG.

In addition, in the non-emission period, the display device 31 first sets voltages at both ends of the signal level storage capacitor C1 at the predetermined fixed voltages Vofs and Vss, and then sets the threshold voltage Vth of the transistor TR2 in the signal level storage capacitor C1 by a discharge via the transistor TR2 driving the organic EL element 8 (FIGS. 3A to 3D and FIGS. 4A to 4D (FIGS. 10A to 10E). Thereby variation in light emission luminance due to variation in the threshold voltage Vth of the transistor TR2 is corrected.

Thereafter, in a state in which the transistor TR1 is set in the on state by the writing signal WS, and thus one terminal of the signal level storage capacitor C1 is connected to the signal line SIG, another terminal of the signal level storage capacitor C1 is charged by the transistor TR2 (see the period Tμ in FIGS. 10A to 10E). Thereby variation in light emission luminance due to variation in mobility of the transistor TR2 is corrected.

After correcting the mobility variation, the display device 31 changes the operation of the transistor TR1 to an off state by the writing signal WS. Thereby, the signal level Vsig of the signal line SIG is held in the signal level storage capacitor C1, and thus the light emission luminance of the organic EL element 8 is set.

The display device 31 sets the fixed voltage Vofs of the driving signal Ssig, the fixed voltage Vofs being used to correct the variation in the threshold voltage Vth of the transistor TR2, to a voltage lower than the gradation voltage VsigB of the driving signal Ssig, the gradation voltage VsigB making the organic EL element 8 make display at the black gradation. Thereby, at a point in time when the correction of the variation in the threshold voltage Vth is completed, the gate voltage Vg and the source voltage Vs of the transistor TR2 are set at voltages sufficiently lower than corresponding voltages when the organic EL element 8 makes display at the black gradation (FIGS. 3A to 3D and FIGS. 4A to 4D).

Thereafter, the display device 31 sequentially changes the driving signal Ssig of the signal line SIG to the variable reference voltage Vof that falls according to the gradation of the organic EL element 8 from a voltage higher than the gradation voltage VsigB for black display and the gradation voltage Vsig that corresponds to the gradation of the organic EL element 8 and which rises according to the gradation of the organic EL element 8. In a period in which the driving signal Ssig is set at the variable reference voltage Vof and the gradation voltage Vsig, the transistor TR2 is set in an on state to perform a mobility variation correcting process. Thereafter, the gradation voltage Vsig is held by one terminal of the signal level storage capacitor C1, and thus the light emission luminance of the organic EL element 8 is set.

In the mobility correcting process of the display device 31, because the variable reference voltage Vof falls according to the gradation of the organic EL element 8 from a voltage higher than the gradation voltage VsigB for black display, during a period when the driving signal Ssig in the period Tμ for correcting the mobility is set at the variable reference voltage Vof, the higher the gradation voltage Vsig according to which the organic EL element 8 emits light at high luminance, the lower the voltage retained once as voltage at the other terminal of the signal level storage capacitor C1, which voltage is the source voltage of the transistor TR2. Thereafter, the other terminal of the signal level storage capacitor C1 is set at a voltage according to the gate voltage Vg corresponding to the light emission luminance of the organic EL element 8 by the gradation voltage Vsig.

Thereby, in the present embodiment, the voltage between the terminals of the signal level storage capacitor C1 can be set in a significantly wide dynamic range as compared with the dynamic range of the variable reference voltage Vof and the gradation voltage Vsig forming the driving signal of the signal line. It is thereby possible to drive the signal line SIG by the driving signal having a narrow dynamic range and obtain high luminance.

Specifically, in a case of white display in which the gate-to-source voltage Vgs of the transistor TR2 is set to be a high voltage, the voltage on the organic EL element 8 side of the signal level storage capacitor C1 is retained in a state of being greatly lowered by the variable reference voltage Vof as compared with a case of black display in which the gate-to-source voltage Vgs is set to be a low voltage (FIGS. 3A to 3D and FIGS. 4A to 4D). The voltage at one terminal of the signal level storage capacitor C1 is set to the gradation voltage Vsig in this state. Thus, the voltage between the terminals of the signal level storage capacitor C1 can be greatly increased as compared with a case where a change is directly made from the fixed voltage Vofs to the gradation voltage Vsig to correct the mobility variation without the variable reference voltage Vof being provided. It is thereby possible to drive the signal line by the driving signal having a narrow dynamic range and secure high luminance. It is thus possible to decrease power consumption by reducing the dynamic range of the buffer circuit for the output of the variable reference voltage Vof and the gradation voltage Vsig, and secure high contrast.

Specifically, in a case of black display (FIGS. 3A to 3D), for example, the variable reference voltage Vof is set to a voltage higher than the gradation voltage VsigB for the black display. When the transistor TR1 is turned on by the writing signal WS, the gate voltage Vg of the transistor TR2 rises to the variable reference voltage Vof. The source voltage Vs of the transistor TR2 gradually rises in such a manner as to be interlocked with the rise in the gate voltage Vg of the transistor TR2. When the driving signal Ssig thereafter changes to the gradation voltage Vsig, that is, changes to the gradation voltage VsigB for the black display, the gate voltage Vg of the transistor TR2 changes to the gradation voltage VsigB for the black display.

In this case, in a period in which the driving signal Ssig is set at the variable reference voltage Vof or in a period in which the driving signal Ssig is set at the gradation voltage VsigB, the source voltage Vs of the transistor TR2 rises to a voltage lower than the gate voltage Vg by the threshold voltage Vth, and then the voltage stops rising. Thereby, the voltage between the terminals of the signal level storage capacitor C1 is set to the threshold voltage Vth of the transistor TR2 at which no driving current flows into the organic EL element 8. By thus setting the variable reference voltage Vof when the organic EL element 8 displays the black gradation to a voltage higher than the gradation voltage VsigB, it is possible to allow no current to flow through the organic EL element 8 and completely sink black after the transistor TR1 is turned off by the writing signal WS to start an emission period. Incidentally, in the example of FIGS. 3A to 3D, the source voltage Vs of the transistor TR2 rises to a voltage lower than the gate voltage Vg by the threshold voltage Vth and then the voltage stops rising in the period in which the driving signal Ssig is set at the gradation voltage VsigB. A symbol D in FIGS. 3A to 3D and FIGS. 4A to 4D denotes the dynamic range of the gradation voltage Vsig.

In a case of white display (FIGS. 4A to 4D), on the other hand, the variable reference voltage Vof is set equal to the fixed voltage Vofs. When the transistor TR1 is turned on by the writing signal WS, the gate voltage Vg and the source voltage Vs are maintained at voltages sufficiently lower than the corresponding voltages when the organic EL element 8 is made to make display at the black gradation as described above. When the driving signal Ssig thereafter changes to the gradation voltage Vsig, that is, changes to a gradation voltage VsigW for the white display, the gate voltage Vg of the transistor TR2 changes to the gradation voltage VsigW for the white display. The source voltage Vs of the transistor TR2 gradually rises in such a manner as to be interlocked with the change in the gate voltage Vg of the transistor TR2. Variation in mobility of the transistor TR2 is corrected, and the gradation voltage VsigW for the white display is held by one terminal of the signal level storage capacitor C1.

By setting the variable reference voltage Vof when the organic EL element 8 displays the white gradation to a voltage equal to the fixed voltage Vofs, the display device 31 can set one terminal of the signal level storage capacitor C1 to the gradation voltage Vsig in a state in which the voltage at the other terminal of the signal level storage capacitor C1 is sufficiently lowered by the variable reference voltage Vof. It is thereby possible to increase contrast sufficiently.

(3) Effect of Embodiment

According to the above-described constitution, the voltage at the other terminal of the signal level storage capacitor is set in advance by the variable reference voltage that falls as the gradation used for display is raised, and thereafter the gradation voltage that corresponds to the gradation used for display and which increases as the gradation is raised is set at one terminal of the signal level storage capacitor. It is thereby possible to drive the signal line by the driving signal having a narrow dynamic range and secure high luminance.

In addition, by making the variable reference voltage when the organic EL element as a light emitting element displays the black gradation higher than the gradation voltage, it is possible to sink black display sufficiently.

In addition, by making the variable reference voltage when the light emitting element displays the white gradation equal to the fixed voltage, it is possible to increase contrast sufficiently.

Second Embodiment

It is to be noted that while in the foregoing embodiment, description has been made of a case where one signal line SIG is driven by the driving signal Ssig of one system, the present invention is not limited to this, but is widely applicable to cases where a plurality of signal lines are driven by the driving signal Ssig of one system by time division.

In addition, while in the foregoing embodiment, description has been made of a case where the variable reference voltage is generated in a similar manner to the gradation voltage, the present invention is not limited to this. Various methods can be applied as methods for generating the variable reference voltage, including for example a case where the gradation voltage is subjected to inverting amplification with a predetermined gain and then the variable reference voltage is generated by a level shift.

In addition, while in the foregoing embodiment, description has been made of a case where the organic EL element is used as a light emitting element, the present invention is not limited to this, but is widely applicable to cases where various light emitting elements of a current-driven type are used.

The present invention can be applied to for example an active matrix type display device based on an organic EL element which device uses a polysilicon TFT.

It should be understood by those skilled in the art that various modifications, combinations, sub-combinations and alterations may occur depending on design requirements and other factors insofar as they are within the scope of the appended claims or the equivalents thereof.

What is claimed is:

1. A display device for displaying a desired image on a display section, said display section being formed by arranging pixels in a form of a matrix, by outputting a driving signal for a signal line and a writing signal to the signal line and a scanning line of said display section by a horizontal driving circuit and a vertical driving circuit, wherein said pixel includes a light emitting element, a signal level storage capacitor, a transistor for writing, said transistor for writing being turned on by said writing signal to set a voltage of one terminal of said signal level storage capacitor to a signal level of said signal line, and a transistor for driving, said transistor for driving having a gate and a source connected to two terminals of said signal level storage capacitor, and driving said light emitting element and making said light emitting element emit light according to a voltage between the terminals of said signal level storage capacitor, and said horizontal driving circuit and said vertical driving circuit in a non-emission period in which light emission of said light emitting element is stopped, sequentially set a signal level of said driving signal for the signal line to a fixed voltage lower than a voltage corresponding to a black gradation of said light emitting element, a variable reference voltage that falls as a gradation of said light emitting element is increased, and a gradation voltage that corresponds to the gradation at which to make said light emitting element emit light and which increases as the gradation at which to make said light emitting element emit light is increased, during a period during which the signal level of said driving signal for the signal line is set at said fixed voltage, make said transistor for writing perform an on operation by said writing signal to set the voltage of one terminal of said signal level storage capacitor to said fixed voltage, and charge another terminal of said signal level storage capacitor by said transistor for driving to set the voltage between the terminals of said signal level storage capacitor to a threshold voltage of said transistor for driving, during a period during which the signal level of said driving signal for the signal line is set at said variable reference voltage and said gradation voltage, make said transistor for writing perform an on operation by said writing signal to set the voltage of one terminal of said signal level storage capacitor to said variable reference voltage, and set a voltage of the other terminal of said signal level storage capacitor to a voltage corresponding to said variable reference voltage, and then set the voltage of one terminal of said signal level storage capacitor to said gradation voltage, charge the other terminal of said signal level storage capacitor by said transistor for driving, and make said transistor for writing perform an off operation, whereby variation in mobility of said transistor for driving is corrected, and said gradation voltage is held by said signal level storage capacitor, and when said light emitting element displays a black gradation, generate said variable reference voltage that is a high voltage higher than said gradation voltage and which falls from said high voltage as the gradation of said light emitting element is increased.

2. The display device according to claim 1, wherein said variable reference voltage when said light emitting element displays the black gradation is a voltage higher than said gradation voltage.

3. The display device according to claim 1, wherein said variable reference voltage when said light emitting element displays a white gradation is a voltage equal to said fixed voltage.

4. A driving method of a display device for displaying a desired image on a display section, said display section being formed by arranging pixels in a form of a matrix, by outputting a driving signal for a signal line and a writing signal to the signal line and a scanning line of said display section, wherein said pixel includes a light emitting element, a signal level storage capacitor, a transistor for writing, said transistor for writing being turned on by said writing signal to set a voltage of one terminal of said signal level storage capacitor to a signal level of said signal line, and a transistor for driving, said transistor for driving having a gate and a source connected to two terminals of said signal level storage capacitor, and driving said light emitting element and making said light emitting element emit light according to a voltage between the terminals of said signal level storage capacitor, said driving method comprising the steps of:

in a non-emission period in which light emission of said light emitting element is stopped, sequentially setting a signal level of said driving signal for the signal line to a fixed voltage lower than a voltage corresponding to a black gradation of said light emitting element, a variable reference voltage that falls as a gradation of said light emitting element is increased, and a gradation voltage that corresponds to the gradation at which to make said light emitting element emit light and which increases as the gradation at which to make said light emitting element emit light is increased;

during a period during which the signal level of said driving signal for the signal line is set at said fixed voltage, making said transistor for writing perform an on operation by said writing signal to set the voltage of one terminal of said signal level storage capacitor to said fixed voltage, and charging another terminal of said signal level storage capacitor by said transistor for driving to set the voltage between the terminals of said signal level storage capacitor to a threshold voltage of said transistor for driving;

during a period during which the signal level of said driving signal for the signal line is set at said variable reference voltage and said gradation voltage, making said transistor for writing perform an on operation by said writing signal to set the voltage of one terminal of said signal level storage capacitor to said variable reference voltage, and setting a voltage of the other terminal of said signal level storage capacitor to a voltage corresponding to said variable reference voltage, and then setting the voltage of one terminal of said signal level storage capacitor to said gradation voltage, charging the other terminal of said signal level storage capacitor by said transistor for driving, and making said transistor for writing perform an off operation, whereby variation in mobility of said transistor for driving is corrected, and said gradation voltage is held by said signal level storage capacitor; and when said light emitting element displays a black gradation, generating said variable reference voltage that is a high voltage higher than said gradation voltage and which falls from said high voltage as the gradation of said light emitting element is increased.

* * * * *